United States Patent [19]

Ohkoshi et al.

[11] Patent Number: 4,498,437

[45] Date of Patent: Feb. 12, 1985

[54] CENTRIFUGAL GOVERNOR FOR INTERNAL COMBUSTION ENGINE

[75] Inventors: Masayoshi Ohkoshi, Matsuyama; Yoshiro Suzuno, Kawagoe, both of Japan

[73] Assignee: Diesel Kiki Company, Ltd., Tokyo, Japan

[21] Appl. No.: 447,382

[22] Filed: Dec. 6, 1982

[30] Foreign Application Priority Data

Dec. 19, 1981 [JP] Japan ..... 56-190177[U]

[51] Int. Cl.[3] ..... F02D 1/04

[52] U.S. Cl. ..... 123/373; 123/365; 123/374

[58] Field of Search ..... 123/366, 373, 374, 365, 123/364, 372

[56] References Cited

U.S. PATENT DOCUMENTS 3,727,598 4/1973 Knapp ..... 123/365

4,286,558 9/1981 Djordjevic ..... 123/373

FOREIGN PATENT DOCUMENTS 1171201 5/1964 Fed. Rep. of Germany ..... 123/374

*Primary Examiner*—Charles J. Myhre

*Assistant Examiner*—Carl S. Miller

*Attorney, Agent, or Firm*—David G. Alexander

[57] ABSTRACT

A centrifugal governor ensures a positive engine starting operation as well as a smoke control in the low engine speed range and a usual fuel injection control responsive to an increase in engine speed. A control rod with a rack is operatively connected with a floating lever through a spring biased piston and cylinder assembly, so that the control rod can be freely moved to its maximum fuel injection position during engine starting without being effected by a smoke limiter, which may be associated with the governor for a smoke control purpose. A unique lever mechanism is operable to move the control rod to the maximum fuel injection position during engine starting but, after a predetermined engine speed is reached, yields to a movement of the control rod in a fuel decreasing direction caused by the floating lever through the piston and cylinder assembly.

10 Claims, 1 Drawing Figure

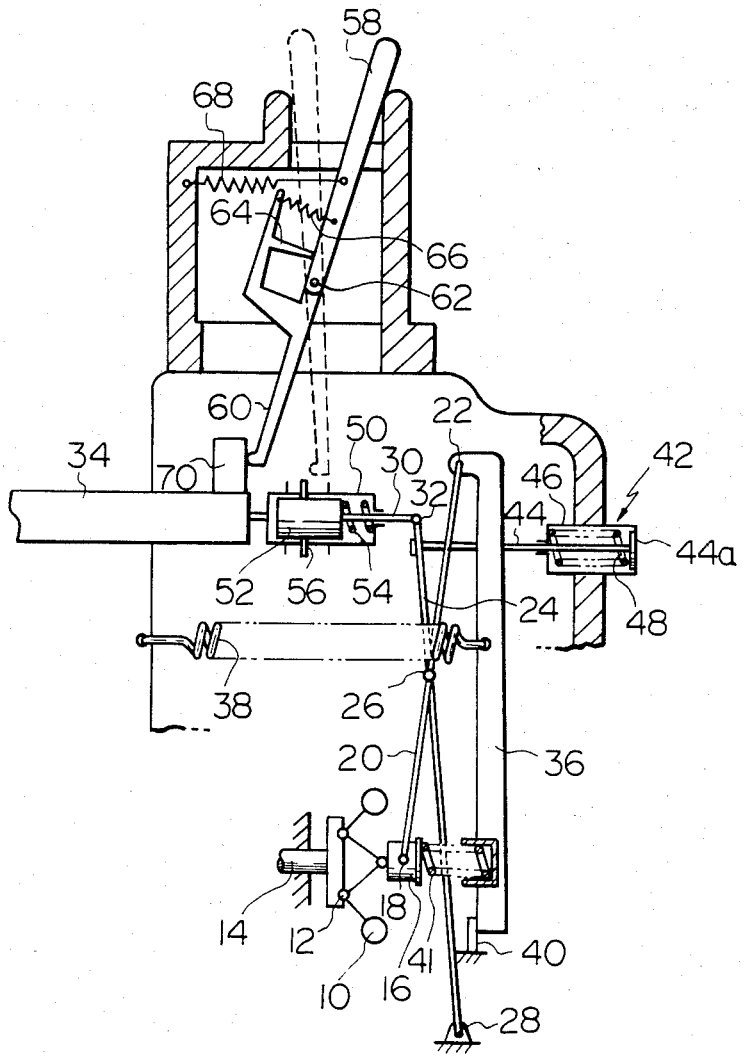
58
68
64
66
62
60
22
50
30
42
34
70
32
46
44
44a
52
56
54
24
48
38
26
20
36
14
12
18
41
40
10
16
28

CENTRIFUGAL GOVERNOR FOR INTERNAL COMBUSTION ENGINE

BACKGROUND OF THE INVENTION

The present invention relates to a centrifugal governor for an internal combustion engine such as a Diesel engine and, more particularly, to a device installed in a centrifugal governor for supplying the maximum fuel injection volume when an engine is to start up.

An engine operating in the low speed range tends to produce smoky exhaust gases which pollute the environment. Implements heretofore proposed to eliminate the smoke emission include a smoke limiter which regulates the movement of a floating lever of a governor in a fuel increasing direction by means of a spring. The spring is preloaded between the floating lever and a wall of a governor casing in such a manner as to limit the angular movement of the floating lever in the fuel increasing direction. Although the smoke limiter is successful in eliminating the smoke emission, it potentially contradicts a demand for efficient engine starting. Should the fuel injection volume fail to be increased during engine starting, the starting efficiency would naturally be deteriorated.

SUMMARY OF THE INVENTION

A centrifugal governor for an internal combustion engine embodying the present invention has flyweights responsive to an engine speed, a shifter rod, driven by the flyweights to move against a governor spring which acts on the shifter rod through a tension lever, a guide lever pivotally connected with the shifter rod, and a floating lever pivotally connected with the guide lever to transmit a displacement of the guide lever to a control rod of a fuel injection pump. First means yieldably forces the control rod to a maximum fuel injection volume position in a fuel increasing direction when the engine is to start up. Second means moves the control rod in a fuel decreasing direction opposite to the fuel increasing direction while causing the first means to yield, in response to a predetermined engine speed during engine starting. With this construction, the fuel injection volume from the pump is increased to the maximum during engine starting and, thereafter, controlled in accordance with a varying engine speed.

A centrifugal governor in accordance with the present invention ensures a positive engine starting operation as well as a smoke control in the low engine speed range and a usual fuel injection control responsive to an increase in engine speed. A control rod with a rack is operatively connected with a floating lever through a spring biased piston and cylinder assembly, so that the control rod can be freely moved to its maximum fuel injection volume position during engine starting without being effected by a smoke limiter, which may be associated with the governor for smoke control purpose. A unique lever mechanism is operable to move the control rod to the maximum fuel injection position during engine starting but, after a predetermined engine speed is reached, yields to a movement of the control rod in a fuel decreasing direction caused by the floating lever through the piston and cylinder assembly.

It is an object of the present invention to provide a centrifugal governor for an internal combustion engine which achieves both the conflicting demands for a smoke control and an efficient start-up of an engine.

It is another object of the present invention to provide a generally improved centrifugal governor for an internal combustion engine.

Other objects, together with the foregoing, are attained in the embodiment described in the following description and illustrated in the accompanying drawings.

BRIEF DESCRIPTION OF THE DRAWING

A single FIGURE is a schematic side elevation of a centrifugal governor for an internal combustion engine embodying the present invention.

DESCRIPTION OF THE PREFERRED EMBODIMENT

While the centrifugal governor for an internal combustion engine of the present invention is susceptible of numerous physical embodiments, depending upon the environment and requirements of use, a substantial number of the herein shown and described embodiment have been made, tested and used, and all have performed in an eminently satisfactory manner.

Referring to the FIGURE, the centrifugal governor includes flyweights 10 which are connected by pins 12 to a camshaft 14 of a fuel injection pump (not shown). The flyweights 10 are arranged to expand by centrifugal force developed by rotation thereof by the camshaft 14 and axially move a shifter rod 16 rightward as the engine speed increases. The shifter rod 16 is connected by a pin 18 to the lower end of a guide lever 20 which is in turn pivotally mounted to a governor casing (not designated) through a shaft 22. A floating lever 24 is pivotally connected to the guide lever 20 by a pin 26 and is supported by the casing through a pin 28 at its lower end. The upper end of the floating lever 24 is connected to a rod 30 by a pin 32 and, through the rod 30 and means which will be described, with a control rod which is formed with a rack (not shown). The control rod 34 is operatively connected to the fuel injection pump to control the volume of fuel injected therefrom into the engine. The rack of the control rod 34 may engage with control sleeves of the fuel injection pump, or be connected to control the fuel injection pump in any other manner. A tension lever 36, like the guide lever 12, is supported by the casing through the pin 22. A governor spring 38 is anchored at one end to the tension lever 36 and at the other end to the casing, thereby constantly urging the tension lever 36 into contact with a stop 40 which forms part of the casing. Further, an idling spring 41 is loaded between the shifter rod 16 and the tension lever 36.

A smoke limiter mechanism generally designated by the reference numeral 42 includes a rod 44 which is formed with a spring seat or flange **44*a* at one end thereof and caused to protrude from a hollow cylindrical section 46, which is formed integrally with the casing. The other or outermost end of the rod 44 is passed through an upper end portion of the floating lever 24 and configured to be prevented from separating from the floating lever 24 during rightward movement. A smoke limit spring 48 abuts against the spring seat 44*a* at one end and against the left end wall of the cylindrical section 46** at the other end.

Interposed between the floating lever 24 and the control rod 34 is an assembly of a cylinder 50 and a piston 52 which is slidably received in the cylinder 50. The cylinder 50 is rigidly connected with the control rod 34 while the piston 52 is rigidly connected with the rod 30, which is pivotally connected with the upper end of the floating lever 24. A spring 54 is preloaded in the cylinder 50 to constantly bias the piston 52 leftward in the drawing. The relative movement between the cylinder 50 and piston 52 is limited by slots formed through the cylinder 50 and lugs 56 extending to the outside of the cylinder 50 from the piston 52 through the slots.

A start lever 58 and a follower lever 60 are pivotally mounted to an upper portion of the casing by a shaft 62. The follower lever 60 is formed with an arm or abutment 64 which is biased by a spring 66 into engagement with the start lever 58. With this arrangement, the lever 60 is moved integrally with the start lever 58 during clockwise rotation of the latter, but is capable of moving counterclockwise relative to the start lever 58 when so urged by an external force. A return spring 68 is anchored at one end to the casing and at the other end to the start lever 58 to bias the lever 58 counterclockwise. The lower end of the lever 60 is engagable with a projection 70 which extends from the control rod 34. The preload of the spring 66 is selected to be larger than that of the spring 54.

The centrifugal governor having the above construction will be operated as follows.

At the start of an engine operation, the start lever 58 is manipulated clockwise about the shaft 62 against the action of the spring 68 until it abuts against a suitable stop. Such a position of the start lever 58 is indicated by a solid line in the drawing. The lever 60 is moved clockwise integrally with the start lever 58 so that its lower end pushes the control rod 34 through the projection 70 to the left in the drawing, i.e. in a fuel increasing direction. Although the smoke limiter mechanism 42 is constructed to limit the angular movement of the floating lever 24 in the fuel increasing direction, the control rod 34 is permitted to stroke without being effected by the mechanism 42 because the cylinder 50 integral with the control rod 34 moves relative to the piston 52 compressing the spring 54. It will be recalled here that the preload of the spring 66 is larger than that of the spring 54. The control rod 34 thus achieves a position to provide the maximum fuel injection volume Which ensures higher efficiency of engine start-up.

As the engine reaches a state of complete expansion the camshaft 14 of the fuel injection pump is rotated to expand the flyweights 10. Then, the shifter 6 is moved rightward by the flyweights 10 until the centrifugal force becomes equilibrated with the force of the idling spring 41. This causes the guide lever 20 to move counterclockwise about the shaft 22 and, thereby, the floating lever 24 connected with the guide lever 20 by the pin 26 to move clockwise about the pin 28. At this instant, the piston 52 is moved to the right compressing the spring 54. When the load of the spring 54 increases beyond that of the spring 66, the cylinder 50 and control rod 34 are integrally moved rightward or in a fuel decreasing direction to in turn push the follower lever 60 counterclockwise about the shaft 62 relative to the start lever 58. The control rod 60 is stopped in a position where the loads of the springs 54 and 66 come into equilibrium with each other.

The start lever 58 is released when the engine operation has reached an idling speed. Then, the start lever 58 and follower lever 60 are both pulled by the return spring 68 to the position indicated by a phantom line in the drawing. The cylinder 50 and control rod 34 are returned to the right or in the fuel decreasing direction by the spring 54 until the leftmost edge of each slot of the cylinder 50 abuts against the corresponding lug 56 on the piston 52. Thereafter, the shifter rod 16 actuated by the flyweights 10 causes the floating lever 24 to swing clockwise about the pin 28 to a position where the displacement balances with the force of the idling spring 41, thereby drawing the control rod 34 in the fuel decreasing direction to a position which matches with an engine load. Upon increase in engine load, on the other hand, the procedure mentioned above occurs in the opposite direction so that the control rod 34 is urged in the fuel increasing direction until its position balances with the load. The predetermined idling speed of the engine is maintained in this manner.

For a usual loaded operation of the engine, the floating lever 24 is moved in either direction as by an accelerator pedal of a motor vehicle in order to displace the control rod 34 accordingly. The expected function of the smoke limiter 42 is available under this condition. The floating lever 24 moving in the fuel increasing direction abuts against the left end of the rod 44 and its further movement is suppressed by the smoke limit spring 48. This hardly allows the control rod 34 to move beyond the maximum fuel injection position and, therefore, prevents emission of smoky exhaust gases.

In summary, it will be seen that the present invention provides a centrifugal governor which disables a smoke limiter during engine starting to provide the maximum volume of fuel injection while abling the smoke limiter under the other conditions to provide an effective smoke control.

Various modifications will become possible for those skilled in the art after receiving the teachings of the present disclosure without departing from the scope thereof. For example, the cylinder 50 may be connected with the floating lever 24 and the piston 52 with the control rod 34. Then, the spring 54 will be located at the opposite side in the cylinder 50 with respect to the piston 52.

What is claimed is:

1. In a centrifugal governor for an internal combustion engine having flyweights responsive to an engine speed, a shifter rod driven by the flyweights to move against a governor spring which acts on the shifter rod through a tension lever, a guide lever pivotally connected with the shifter rod, and a floating lever pivotally connected with the guide lever to transmit a displacement of the guide lever to a control rod of the fuel injection pump, the improvement comprising:

first means for yieldably forcing the control rod to a maximum fuel injection volume position in a fuel increasing direction when the engine is to be started up; and second means for moving the control rod in a fuel decreasing direction opposite to the fuel increasing direction while causing the first means to yield, in response to a predetermined engine speed during engine starting;

whereby the fuel injection volume from the pump is increased to the maximum during engine starting and, thereafter, controlled in accordance with a varying engine speed;

the first means comprising an articulated lever assembly engagable with the control rod at one end thereof and the second means comprising a relatively slidable assembly disposed between the floating lever and the control rod;

the articulated lever assembly comprising a first lever and a second lever pivotally mounted at one end thereof on a common shaft, said first lever being operated into an angular movement at the other end, said second lever being engagable with the control rod at the other end.

2. The improvement as claimed in claim 1, in which the articulated lever assembly further comprises a resilient means for biasing the second lever such that the second lever is movable integrally with the first lever during movement of the first lever which is to urge the control rod in the fuel increasing direction, and is movable relative to the first lever when the relatively slidable assembly moves the control rod in the fuel decreasing direction.

3. The improvement as claimed in claim 2, in which the articulated lever means further comprises an abutment which forms part of the second lever and engagable with the first lever, the resilient means extending between said abutment and the first lever to bias the abutment into engagement with the first lever.

4. The improvement as claimed in claim 2, in which the resilient means comprises a spring.

5. In a centrifugal governor for an internal combustion engine having flyweights responsive to an engine speed, a shifter rod driven by the flyweights to move against a governor spring which acts on the shifter rod through a tension lever, a guide lever pivotally connected with the shifter rod, and a floating lever pivotally connected with the guide lever to transmit a displacement of the guide lever to a control rod of the fuel injection pump, the improvement comprising:

first means for yieldably forcing the control rod to a maximum fuel injection volume position in a fuel increasing direction when the engine is to be started up; and second means for moving the control rod in a fuel decreasing direction opposite to the fuel increasing direction while causing the first means to yield, in response to a predetermined engine speed during engine starting;

whereby the fuel injection volume from the pump is increased to the maximum during engine starting and, thereafter, controlled in accordance with a varying engine speed;

the first means comprising an articulated lever assembly engagable with the control rod at one end thereof and the second means comprising a relatively slidable assembly disposed between the floating lever and the control rod;

the relatively slidable assembly comprising a cylinder and a piston slidably received in the cylinder, said cylinder being connected with one of the floating piston and control rod and said piston being connected with the other.

6. The improvement as claimed in claim 5, in which the relatively slidable assembly further comprises a resilient means for biasing the control rod in the fuel decreasing direction.

7. The improvement as claimed in claim 6, in which the resilient means comprises a spring interposed between the cylinder and the piston.

8. The improvement as claimed in claim 5, in which the relatively slidable assembly further comprises means for limiting the relative movement between the piston and the cylinder to a predetermined range.

9. The improvement as claimed in claim 8, in which the means for limiting the relative movement comprises a lug extending radially outward from the piston and a slot formed through the cylinder to receive said lug therein.

10. In a centrifugal governor for an internal combustion engine having flyweights responsive to an engine speed, a shifter rod driven by the flyweights to move against a governor spring which acts on a shifter rod through a tension lever, a guide lever pivotally connected with the shifter rod, and a floating lever pivotally connected with the guide lever to transmit a displacement of the guide lever to a control rod of a fuel injection pump, the improvement comprising:

a first lever pivotally mounted at one end thereof on a shaft and operated into an angular movement at the other end, said shaft being supported by a casing of the governor;

a second lever pivotally mounted at one end on said shaft and engagable with the control rod at the other end, said second lever including an abutment which is engagable with the first lever;

a first spring extending between said abutment and the first lever to bias the abutment into engagement with the first lever;

a cylinder connected with one end of the floating piston and control rod;

a piston slidably received in said cylinder and connected with the other of the floating piston and control rod;

a second spring interposed between the cylinder and the piston;

the first lever, second lever and first spring constituting first means for yieldably forcing the control rod to a maximum fuel injection volume position in a fuel increasing direction when the engine is to be started up;

the cylinder, piston and second spring constituting second means for moving the control rod in a fuel decreasing direction opposite to the fuel increasing direction while causing the first means to yield, in response to a predetermined engine speed during engine starting;

whereby the fuel injection volume from the pump is increased to the maximum during engine starting and, thereafter, controlled in accordance with a varying engine speed.

* * * * *